US007568476B2

(12) United States Patent
Yamada

(10) Patent No.: US 7,568,476 B2
(45) Date of Patent: Aug. 4, 2009

(54) AIR-FUEL RATIO CONTROL SYSTEM FOR INTERNAL COMBUSTION ENGINE

(75) Inventor: Eijirou Yamada, Hekinan (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/907,030

(22) Filed: Oct. 9, 2007

(65) Prior Publication Data

US 2008/0087260 A1 Apr. 17, 2008

(30) Foreign Application Priority Data

Oct. 13, 2006 (JP) ..... 2006-280103
Oct. 13, 2006 (JP) ..... 2006-280104

(51) Int. Cl.
*F02D 41/00* (2006.01)
*F02D 41/02* (2006.01)

(52) U.S. Cl. ..... 123/674; 123/703

(58) Field of Classification Search ..... 123/703, 123/674, 672, 692
See application file for complete search history.

(56) References Cited

U.S. PATENT DOCUMENTS 5,392,599 A * 2/1995 Hamburg et al. ..... 60/274
5,582,150 A * 12/1996 Reed et al. ..... 123/406.47
5,598,702 A * 2/1997 Uchikawa ..... 60/274
5,638,800 A * 6/1997 Furuya et al. ..... 123/674
5,706,654 A * 1/1998 Nagai ..... 60/276
5,749,221 A * 5/1998 Kawahira et al. ..... 60/274
6,932,069 B2 * 8/2005 Suyama et al. ..... 123/674
2006/0185655 A1 * 8/2006 Mitsutani ..... 123/674

FOREIGN PATENT DOCUMENTS

JP 2001-082221 3/2001

* cited by examiner

*Primary Examiner*—Mahmoud Gimie
(74) *Attorney, Agent, or Firm*—Nixon & Vanderhye P.C.

(57) ABSTRACT

When detecting the data showing an output characteristics of an air-fuel ratio sensor, the air-fuel ratio (feed air-fuel ratio) supplied to each cylinder is alternately changed to rich or lean by a predetermined ratio (X %). And then, the average value of the detected air-fuel ratio λ in the rich side and the lean side is respectively computed. A ratio between the variation width of the air-fuel ratio and the detection variation of the air-fuel ratio sensor 20 is computed as an output-characteristics correction value for correcting the dispersion in the output characteristics of the air-fuel ratio sensor. By correcting the air-fuel ratio detection of the air-fuel ratio sensor with this output-characteristics correction value, the dispersion in the output characteristics due to manufacturing tolerances, aged deterioration, etc. of the air-fuel ratio sensor is corrected.

14 Claims, 6 Drawing Sheets

AIR-FUEL RATIO CONTROL SYSTEM FOR INTERNAL COMBUSTION ENGINE

CROSS-REFERENCE TO RELATED APPLICATION

This application is based on Japanese Patent Applications No. 2006-280103 filed on Oct. 13, 2006 and No. 2006-280104 filed on Oct. 13, 2006, the disclosure of which are incorporated herein by reference.

FIELD OF THE INVENTION

The present invention relates to an air-fuel ratio control system for an internal combustion engine having a function which corrects dispersion in the output characteristics due to a manufacturing tolerances, an deterioration with age, and the like of an air-fuel ratio sensor (A/F sensor).

BACKGROUND OF THE INVENTION

In an apparatus described to JP-2001-82221A, an air-fuel ratio sensor (A/F sensor) which detects an air-fuel ratio of the exhaust gas is installed at an exhaust confluent part into which the exhaust gas of a plurality of cylinder flows, and the catalyst for exhaust-gas clarification is installed downstream of the air-fuel ratio sensor. A signal of the air-fuel ratio sensor is extracted for each cylinder, and fuel injection quantity is controlled with respect to each cylinder based on the extracted signal. Thereby, the air-fuel-ratio dispersion between the cylinders is corrected for each cylinder, and the exhaust air purification of the catalyst is enhanced.

As shown in FIG. 4, in the output characteristics of the air-fuel ratio sensor, there is a region in which the output current (limiting current value) changes almost linearly according to the air-fuel ratio λ. The output current of this air-fuel ratio sensor is detected, and it is changed into the air-fuel ratio λ. The output characteristics of this air-fuel ratio sensor varies due to a manufacturing tolerances, a deterioration with age, and the like. The inclination of the output-characteristics line changes due to the manufacturing tolerances, the deterioration with age, and the like. For this reason, even if an air-fuel ratio control for each cylinder is performed, the dispersion in output characteristics deteriorates the detecting accuracy of the air-fuel ratio and the accuracy of the air-fuel ratio control.

SUMMARY OF THE INVENTION

The present invention is made in view of the above matters. An object of the present invention is to provide an air-fuel ratio control system for an internal combustion engine which can corrects the dispersion in the output characteristics due to manufacturing tolerances, aged deterioration, and the like of the air-fuel ratio sensor, and can improve the detection accuracy of the air-fuel ratio.

According to the present invention, the system includes an air-fuel ratio sensor which detects an air-fuel ratio of exhaust gas in an exhaust passage of the internal combustion engine. The system controls the air-fuel ratio (feed air-fuel ratio) which is supplied to the internal combustion engine based on an output of the air-fuel ratio sensor. The air-fuel ratio control system includes an output-characteristics detection means for detecting output-characteristics data showing output characteristics of the air-fuel ratio sensor, and a sensor output correction means for correcting the output of the air-fuel ratio sensor or a detected air-fuel ratio based on the output-characteristics data detected by the output-characteristics detection means. The output-characteristics detection means changes the feed air-fuel ratio to rich/lean, and detects the output-characteristics data by comparing a variation width of rich/lean with a quantity of an output changes in the air-fuel ratio sensor.

According to another aspect of the invention, an air-fuel ratio control system includes a deviation detection means for detecting an air-fuel-ratio deviation for each cylinder based on an output of the air-fuel ratio sensor, an air-fuel-ratio-control means for controlling a fuel injection quantity for each cylinder in such a manner as to decrease the air-fuel-ratio deviation for each cylinder, and an output-characteristics detection means for detecting an output characteristics of the air-fuel ratio sensor. The air-fuel-ratio deviation detection means changes the air-fuel ratio (feed air-fuel ratio) supplied to the internal combustion engine to rich/lean, and detects the air-fuel-ratio deviation for each cylinder, when it is determined that the output characteristics of the air-fuel ratio sensor is deviated relative to an actual air-fuel ratio by a predetermined value or more in a direction in which a change in output current of the air-fuel ratio sensor is decreased. And the air-fuel-ratio deviation detection means detects the air-fuel-ratio deviation for each cylinder without changing the feed air-fuel ratio to rich/lean, when it is determined that the deviation of the output characteristics of the air-fuel ratio sensor is less than the predetermined value

DETAILED DESCRIPTION OF THE PREFERRED EMBODIMENTS

FIRST EMBODIMENT

Figure 1:
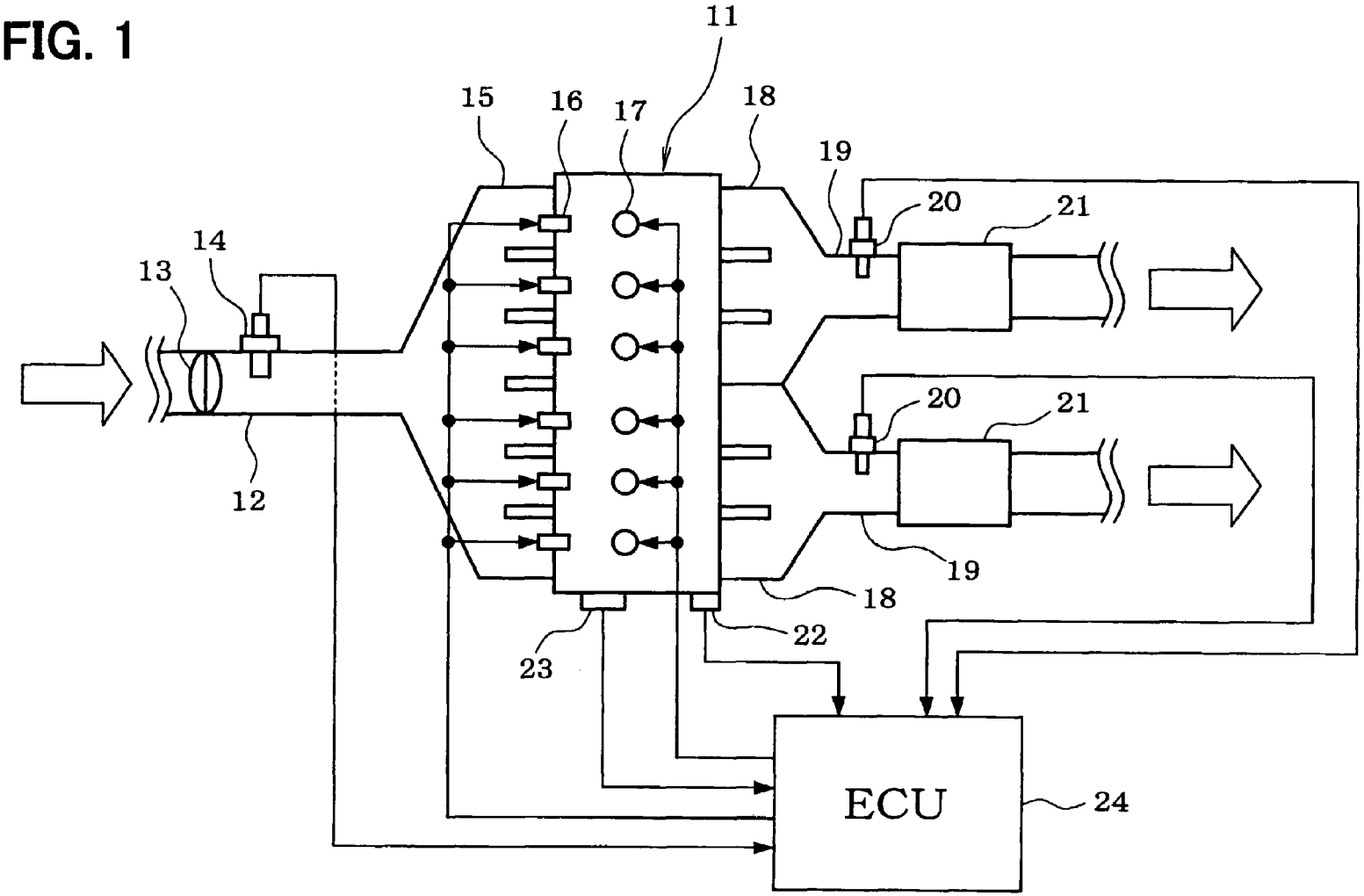
FIG. 1 is a chart schematically showing an engine control system according to a first embodiment of the present invention.

Referring to FIG. 1, an engine control system is explained.

A throttle valve 13 and an intake air sensor 14 detecting an intake air quantity are provided in the intake pipe 12 of the engine 11. An intake manifold 15 which introduces air into each cylinder of the engine 11 is provided downstream of the intake pipe 12, and the fuel injector 16 which injects the fuel is provided at a vicinity of an intake port of the intake manifold 15 of each cylinder. A spark plug 17 is mounted on a cylinder head of the engine 11 corresponding to each cylinder to ignite air-fuel mixture in each cylinder.

The engine 11 has the two exhaust pipes 19 to which the exhaust manifold 18 is connected. An air-fuel ratio sensor 20 which detects the air-fuel ratio of the exhaust gas is respectively provided in each exhaust pipe 19, and a three-way catalyst 21 which purifies the exhaust gas is provided downstream of the air-fuel ratio sensor 20.

A coolant temperature sensor 22 detecting a coolant temperature, and a crank angle senor 23 outputting a pulse signal every predetermined crank angle of a crankshaft of the engine 11 are disposed on a cylinder block of the engine 11. The crank angle and an engine speed are detected based on the output signal of the crank angle sensor 23.

The outputs from the above sensors are inputted into an electronic control unit 24, which is referred to an ECU hereinafter. The ECU 24 includes a microcomputer which executes an engine control program stored in a ROM (Read Only Memory) to control a fuel injection quantity by an injector 16 and an ignition timing of a spark plug 17 according to an engine running condition.

The ECU 24 estimates the air-fuel ratio of each cylinder based on the actual air-fuel ratio, and computes the average value of the estimated air-fuel ratio of all the cylinders. While establishing the average value as the reference air-fuel ratio (target air-fuel ratio of all the cylinders), the deviation between the estimated air-fuel ratio and the reference air-fuel ratio is computed for every cylinder, and the quantity of fuel correction of each cylinder (correction quantity of fuel injection quantity) is computed so that the deviation may become small. The fuel injection quantity of each cylinder is corrected based on the calculating result.

The output characteristics of the air-fuel ratio sensor 20 have dispersion due to manufacturing tolerances, aged deterioration, etc. If the dispersion in these output characteristics is disregarded and the output current of the air-fuel ratio sensor 20 is changed into the air-fuel ratio, the detection accuracy of the air-fuel ratio will fall.

Figure 5:
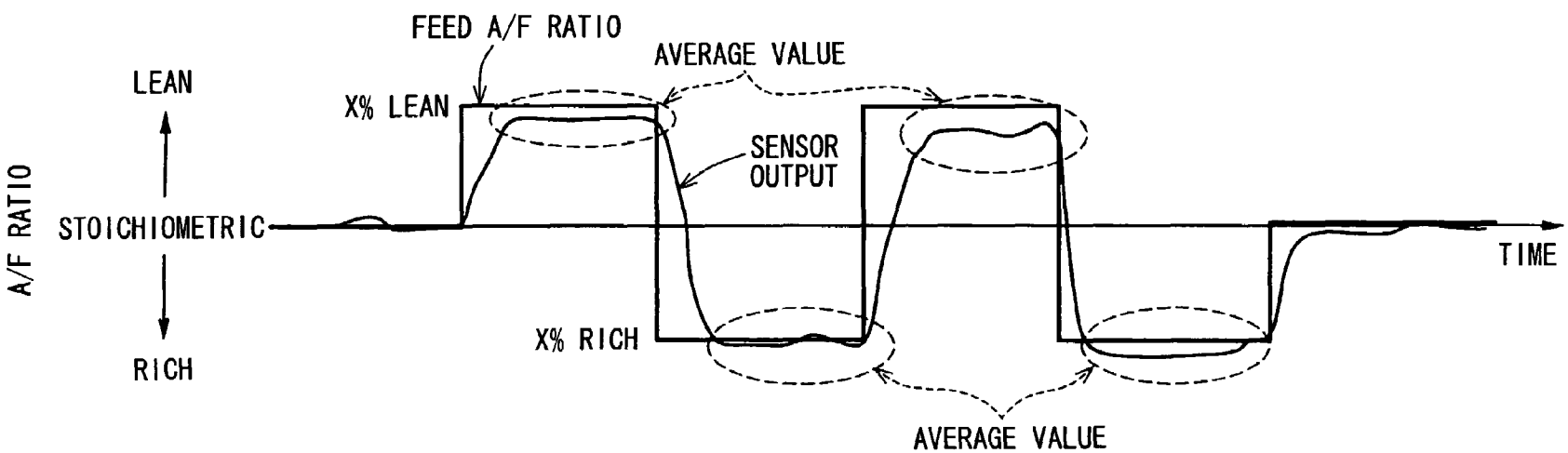
FIG. 5 is a time chart for explaining a change in the output current of the air-fuel ratio sensor.

In this embodiment, the data (output-characteristics data) showing the output characteristics of the air-fuel ratio sensor 20 are detected, and the output of the air-fuel ratio sensor 20 or the detected air-fuel ratio detection is corrected based on this output-characteristics data. Specifically, when detecting the output-characteristics data of the air-fuel ratio sensor 20, as shown in FIG. 5. The air-fuel ratio (henceforth "the feed air-fuel ratio") of the air-fuel mixture supplied to each cylinder of the engine 11 is alternately varied to a rich direction or a lean direction predetermined times by a specified ratio (X %) in a given period. And the average value of the output current in the rich side and the lean side of the air-fuel ratio sensor 20 is respectively computed.

Figure 4:
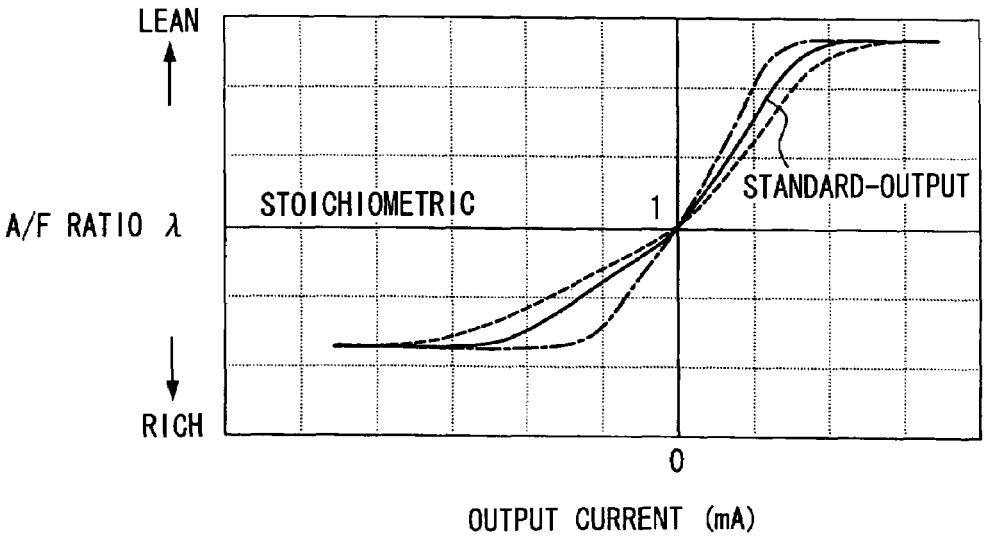
FIG. 4 is a chart for explaining the dispersion in the output characteristics of the air-fuel ratio sensor.

As shown in FIG. 4, when the air-fuel ratio is stoichiometric air-fuel ratio ($\lambda=1$), the output current of the air-fuel ratio sensor 20 is set to "0." Therefore, the average value of the output current of the air-fuel ratio sensor 20 in the rich side and the lean side is equivalent to the output current variation when changing the feed air-fuel ratio from stoichiometric to rich/lean.

In this example, the ratio between the variation width of the air-fuel ratio and the detection variation of the air-fuel ratio sensor 20 is the output-characteristics correction value for correcting the dispersion in the output characteristics of the air-fuel ratio sensor 20. The air-fuel ratio detected by the air-fuel ratio sensor 20 is corrected with this output-characteristics correction value. This output-characteristics correction value is respectively computed in the rich side and the lean side.

Figure 2:
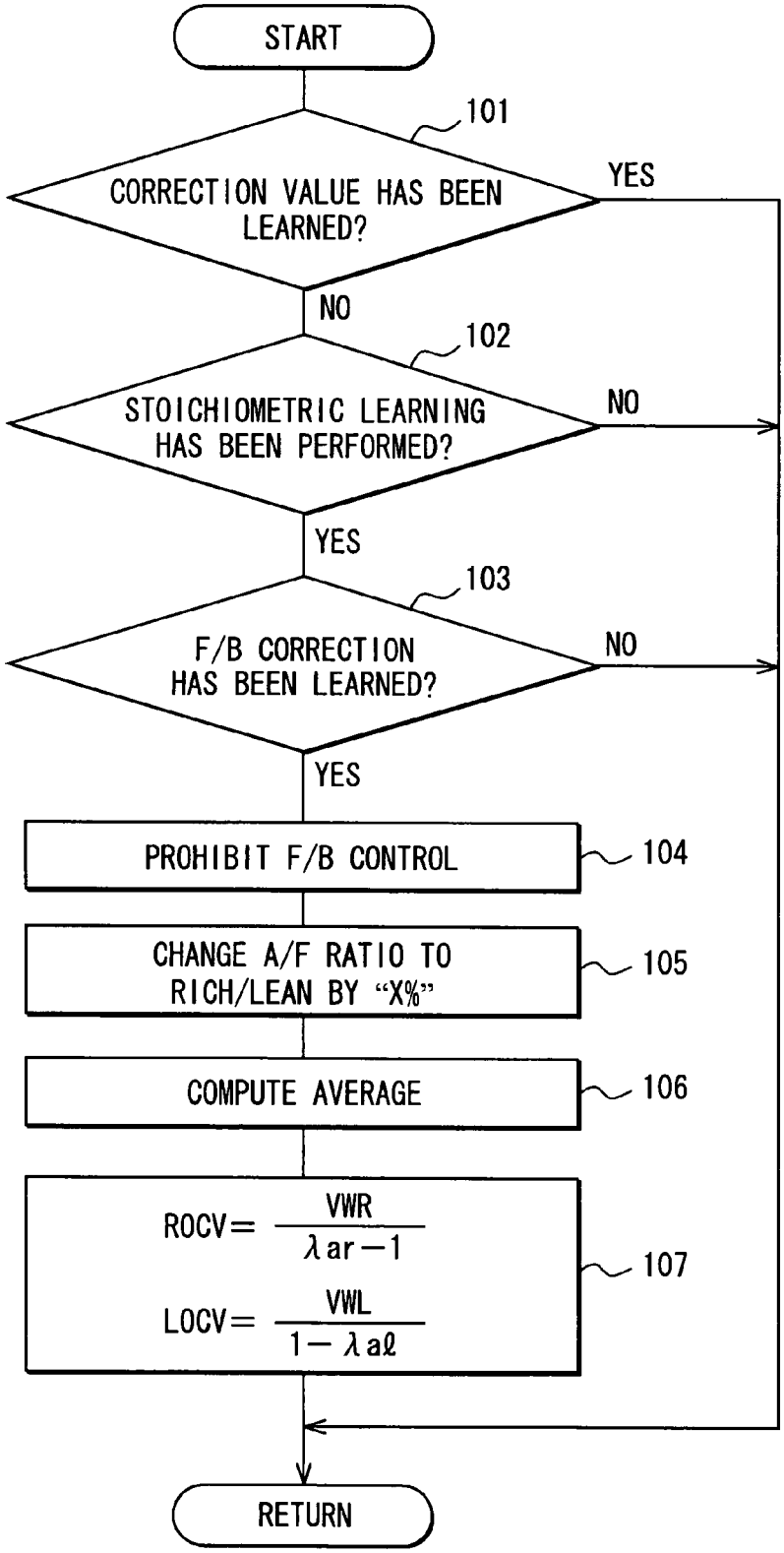
FIG. 2 is a flowchart showing a process of the output-characteristics correction value learning program.
Figure 3:
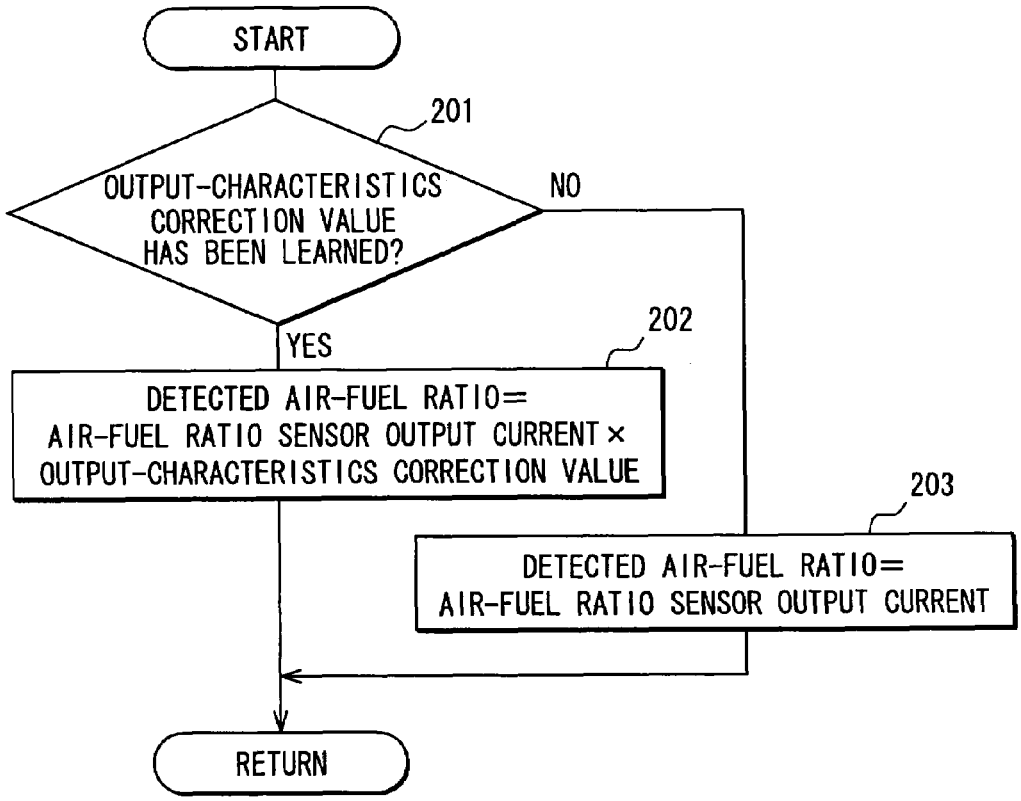
FIG. 3 is a flowchart showing a process of an air-fuel-ratio conversion program.

The output-characteristics amendment processing of the air-fuel ratio sensor 20 is performed according to each program shown in FIGS. 2 and 3.

[Output-Characteristics Correction Value Learning Program]

The output-characteristics correction value learning program of FIG. 2 is executed in a given period during engine operation. In step 101, it is determined whether the output-characteristics correction value has been learned (has been computed). When the answer is Yes in step 101, this program is ended without performing subsequent processes.

When the answer is No in step 101, the output-characteristic correction value is learned as follows. At step 102, it is determined whether stoichiometric learning of the air-fuel ratio sensor 20 has been performed. This stoichiometric learning is learning for performing zero-point adjustment so that the output current of the air-fuel ratio sensor 20 may be set to "0" at the time of the stoichiometric air-fuel ratio. When the air-fuel ratio sensor 20 is in the condition of non-activity (temperature is lower than the active temperature region), the output current of the air-fuel ratio sensor 20 becomes a value equivalent to the stoichiometric air-fuel ratio. Based on this characteristic, when the air-fuel ratio sensor 20 is in the condition of non-activity, the output current of the air-fuel ratio sensor 20 is taken into the ECU 24, and the deviation from the zero point is learned according to the output current. When the answer is No in step 102, this program is ended without performing subsequent processes.

When the answer is Yes in step 102, the procedure proceeds to step 103. In step 103, it is determined whether a F/B correction quantity of air-fuel ratio feed back control has been learned in the operating range where the output-characteristics correction value is learned. The learning of this F/B correction quantity is performed under a condition in which the target air-fuel ratio is established as the stoichiometric air-fuel ratio. The operating range where the output-characteristics correction value is learned is the steady operation region where it is after the completion of warming-up, for example, and engine speed is kept in a specified range. When the answer is No in step 103, this program is ended without performing subsequent processes.

In order to previously learn product tolerances other than the dispersion in the output characteristics of the air-fuel ratio sensor 20, the stoichiometric learning and the learning of F/B correction quantity are required before learning the output-characteristics correction value.

When the answer is Yes in steps 102 and 103, the precondition for learning the output-characteristics correction value is satisfied, and the output-characteristics correction value will be learned as follows. In step 104, the air-fuel-ratio F/B control is prohibited, and the air-fuel ratio is controlled by an open loop control. However, the learnt value of F/B correction quantity is reflected also in this open loop control.

Then, the procedure proceeds to step 105 in which the air-fuel ratio (the feed air-fuel ratio) of the air-fuel mixture supplied to each cylinder of the engine 11 is alternately varied to a rich direction or a lean direction predetermined times by a specified ratio (X %) in a given period, as shown in FIG. 5. In step 106, the average value of the detected air-fuel ratio $\lambda$ in the rich side and the lean side is respectively computed. By accumulating the sampling data of the detection value $\lambda$ to the memory of ECU 24 and performing the arithmetical average, the average value of the air-fuel ratio detection $\lambda$ may be computed. Alternatively, the average value may be approximately computed by smoothing the detected value $\lambda$ in the rich side and the lean side.

In this case, when the feed air-fuel ratio changes twice or more, the average value is computed whenever the feed air-fuel ratio changes. And after change of the feed air-fuel ratio is completed, the arithmetical average of the average value for every change may be performed. Alternatively, the sampling data of the detection value .lamda. are accumulated in the memory of the ECU 24, and the arithmetical average value of the sampling data accumulated in the memory is computed after termination of the oscillation movement of the value λ.

Then, the procedure progresses to step 107. A ratio between a variation width of the air-fuel ratio to the rich side VWR and a variation amount of the rich-side detected value λ is computed. This variation amount of the detected value λ is represented by "an average-value λar−1". This ratio is established as a rich-side output-characteristics correction value ROCV for correcting the dispersion of the rich-side output characteristics of the air-fuel ratio sensor 20. A ratio between a variation width of the air-fuel ratio to the lean side VWL and a variation amount of the lean-side detected value λ is computed. This variation amount of the detected value λ is represented by "1— an average-value λal". This ratio is established as a lean-side output-characteristics correction value LOCV for correcting the dispersion of the lean-side output characteristics of the air-fuel ratio sensor 20. Each output-characteristics correction value ROCV, LOCV is stored in the memory of ECU 24.

$$ROCV=VWR/(\lambda ar-1)$$

$$LOCV=VWL/(1-\lambda al)$$

[Air-Fuel-Ratio Conversion Program]

FIG. 3 shows an air-fuel-ratio conversion program. In step 201, it is determined whether a learning of the output-characteristics correction value has been executed. When the answer is No in step 201, the procedure proceeds to step 203. The output current of the air-fuel ratio sensor 20 is converted into the detected air-fuel ratio, using the conversion table of the standard-output characteristic curve line (medium value of output-characteristics dispersion) shown in FIG. 4. In this case, the correction of output characteristics is not performed.

When the answer is Yes in step 201, the procedure proceeds to step 202. The output current of the air-fuel ratio sensor 20 is converted into the air-fuel ratio using the translation table of the above-mentioned standard output characteristic, the multiplication of the output-characteristics correction value is performed to this value, and detected air-fuel ratio is obtained. That is, the detected air-fuel ratio of the air-fuel ratio sensor 20 is corrected with the output-characteristics correction value.

Detected air-fuel ratio=Air-fuel ratio sensor output current×Output-characteristics correction value Besides, in step 107, the output-characteristics correction value may be computed with the following formula.

$$ROCV=(\lambda ar-1)/VWR$$

$$LOCV=(1-\lambda al)/VWL$$

In this case, the air-fuel ratio obtained by converting the output current of the air-fuel ratio sensor 20 is divided by the output-characteristics correction value so that the detected air-fuel ratio is corrected.

Detected air-fuel ratio=Air-fuel ratio sensor output current+Output-characteristics correction value Alternatively, a map for computing the output-characteristics correction value is previously prepared, which has parameters of air-fuel-ratio variation width and the average value of the detected value λ. The output-characteristics correction value may be computed on this map.

According to the present embodiment described above, the dispersion in the output characteristics due to manufacturing tolerances, aged deterioration, etc. of the air-fuel ratio sensor 20 can be corrected with sufficient accuracy, and the detection accuracy of the air-fuel ratio can be improved.

Besides, a ratio between the variation width from the stoichiometric air-fuel ratio and the output current variation of the air-fuel ratio sensor 20 can be computed as an output-characteristics correction value for correcting the dispersion in the output characteristics of the air-fuel ratio sensor 20.

If air-fuel-ratio F/B control based on the output of the air-fuel ratio sensor 20 is continued when the feed air-fuel ratio changes to rich/lean, the output current variation of the air-fuel ratio sensor 20 will also be changed according to the F/B correction quantity.

According to the present embodiment, since the air-fuel-ratio F/B control based on the output of the air-fuel ratio sensor 20 is prohibited when changing the feed air-fuel ratio, the fluctuation of the output current of the air-fuel ratio sensor 20 is prevented by air-fuel-ratio F/B control, and the output-characteristics correction value can be computed with sufficient accuracy.

In the present invention, when changing the feed air-fuel ratio to rich/lean, it is not indispensable requirements to prohibit air-fuel-ratio F/B control. The output-characteristics correction value may be computed by comparing variation width and the output current variation, while continuing air-fuel-ratio F/B control. Even in this case, if the output current variation of the air-fuel ratio sensor 20 is corrected according to air-fuel-ratio F/B correction quantity, the accuracy of the output-characteristics correction value is securable.

Moreover, in the above-mentioned embodiment, the air duel ratio control is performed for each cylinder. The present invention is applicable also to the system which performs the usual air-fuel-ratio F/B control.

SECOND EMBODIMENT

If the output characteristics of the air-fuel ratio sensor 20 have deviated from the actual air-fuel ratio in a direction in which change of the output current becomes small, the output current of the air-fuel ratio sensor 20 becomes relatively small, so that the detection accuracy of air-fuel-ratio deviation for each cylinder falls and the accuracy of the air-fuel ratio control for each cylinder is deteriorated.

Figure 7:
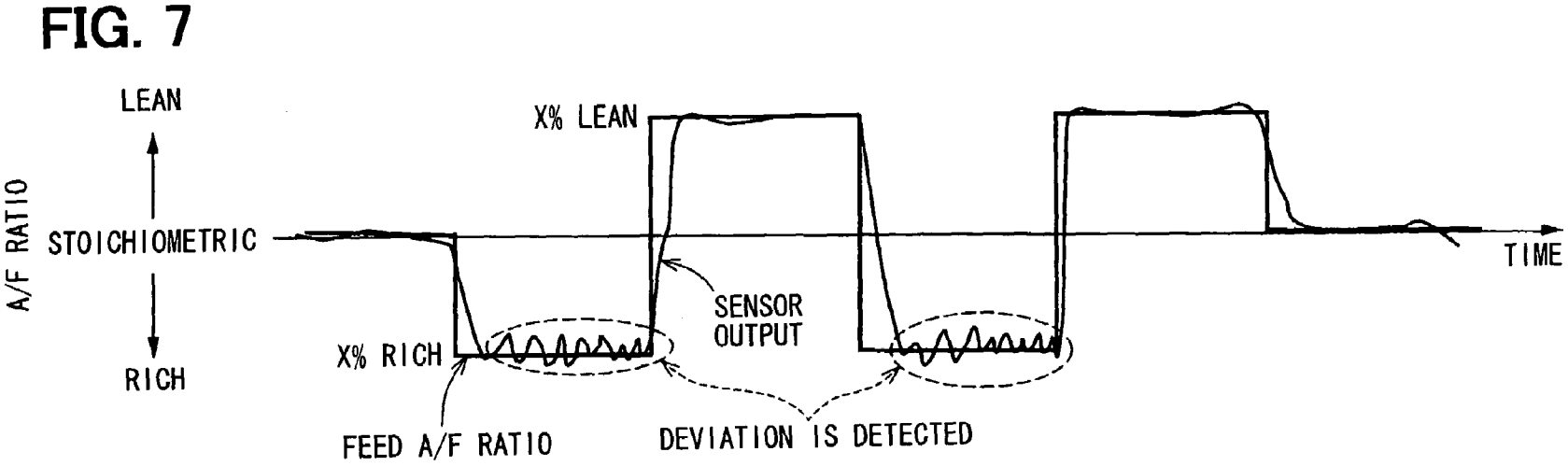
FIG. 7 is a time chart for explaining the process which detects the air-fuel-ratio deviation with changing air-fuel ratio.
Figure 8:
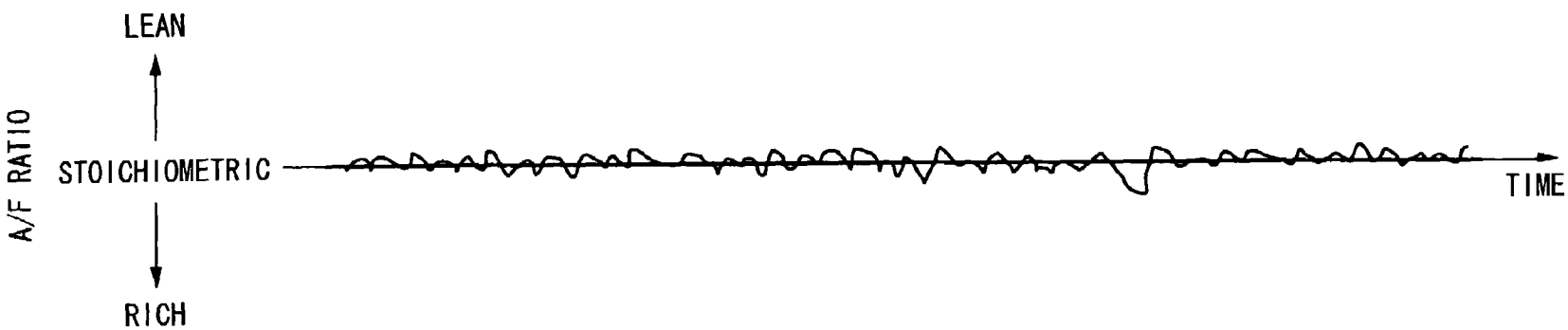
FIG. 8 is a time chart for explaining the process which detects the air-fuel-ratio deviation without changing the air-fuel ratio.

In the second embodiment, the tolerance (deviation) of the output characteristics of the air-fuel ratio sensor 20 is detected. When the output characteristics of the air-fuel ratio sensor 20 is determined that change of the output current is deviated in the direction which becomes small to change of the actual air-fuel ratio beyond as for the specified value, air-fuel ratio (the feed air-fuel ratio) of the air-fuel mixture supplied to each cylinder of the engine 11 is alternately varied to a rich direction or a lean direction predetermined times by a specified ratio (X %) in a given period in order to detect the deviation of air-fuel ratio, as shown in FIG. 7. When it is determined that the tolerance (deviation) of the output characteristics of the air-fuel ratio sensor 20 is less a specified value, the air-fuel-ratio deviation for each cylinder is detected without changing the air-fuel ratio (the feed air-fuel ratio) to the rich direction or lean direction, as shown in FIG. 8.

As shown in FIG. 7, when the air-fuel ratio is near the stoichiometric air-fuel ratio (λ=1), the output current of the air-fuel ratio sensor is approximately zero. If the output characteristics of the air-fuel ratio sensor 20 have deviated from the actual air-fuel ratio in the direction in which the output current becomes small, it is difficult to detect the air-fuel-ratio for each cylinder. Even in this case, since the air-fuel ratio is detectable in the region where the output current of the air-fuel ratio sensor 20 is large if the feed air-fuel ratio is changed to rich/lean, it becomes easy to detect the air-fuel-ratio deviation for each cylinder. And by changing the feed air-fuel ratio to rich/lean alternately, the catalyst 21 is maintained at neutrality, without making it incline toward either rich/lean, and lowering of the exhaust-air-purification capacity of the catalyst 21 is suppressed.

Furthermore, when it is determined the tolerance (deviation) of the output characteristics of the air-fuel ratio sensor 20 is less than the specified value, even if the air-fuel ratio is near the stoichiometric air-fuel ratio, the air-fuel ratio can be accurately detected by the air-fuel ratio sensor 20. For this reason, even if air-fuel-ratio deviation is detected without changing the feed air-fuel ratio to rich/lean, the air-fuel-ratio deviation according to cylinder is detectable with sufficient accuracy. And since the feed air-fuel ratio is not changed to rich/lean, exhaust emission is not increased.

Moreover, in present embodiment, when detecting the tolerance (deviation) of the output characteristics of the air-fuel ratio sensor 20, as shown in FIG. 5, the feed air-fuel ratio (target air-fuel ratio) of each cylinder is alternately changed to rich/lean direction a predetermined time by a predetermined rate (X %) in a certain period. And the output current of the rich/lean direction of the air-fuel ratio sensor 20 is detected, and the average value of the air-fuel ratio detection of the rich/lean direction is computed, respectively. And the difference of the feed air-fuel ratio (target air-fuel ratio) changing to rich/lean direction and the average value of air-fuel ratio detection is computed as a tolerance (deviation) of the output characteristics of the air-fuel ratio sensor 20. Alternatively, the difference of the variation of the feed air-fuel ratio from the stoichiometric air-fuel ratio and the average value of the detected air-fuel-ratio variation of the air-fuel ratio sensor 20 may be computed as a tolerance (deviation) of the output characteristics of the air-fuel ratio sensor 20. The tolerance (deviation) of the output characteristics of the air-fuel ratio sensor 20 may be computed by either the lean side or the lean side.

Figure 6:
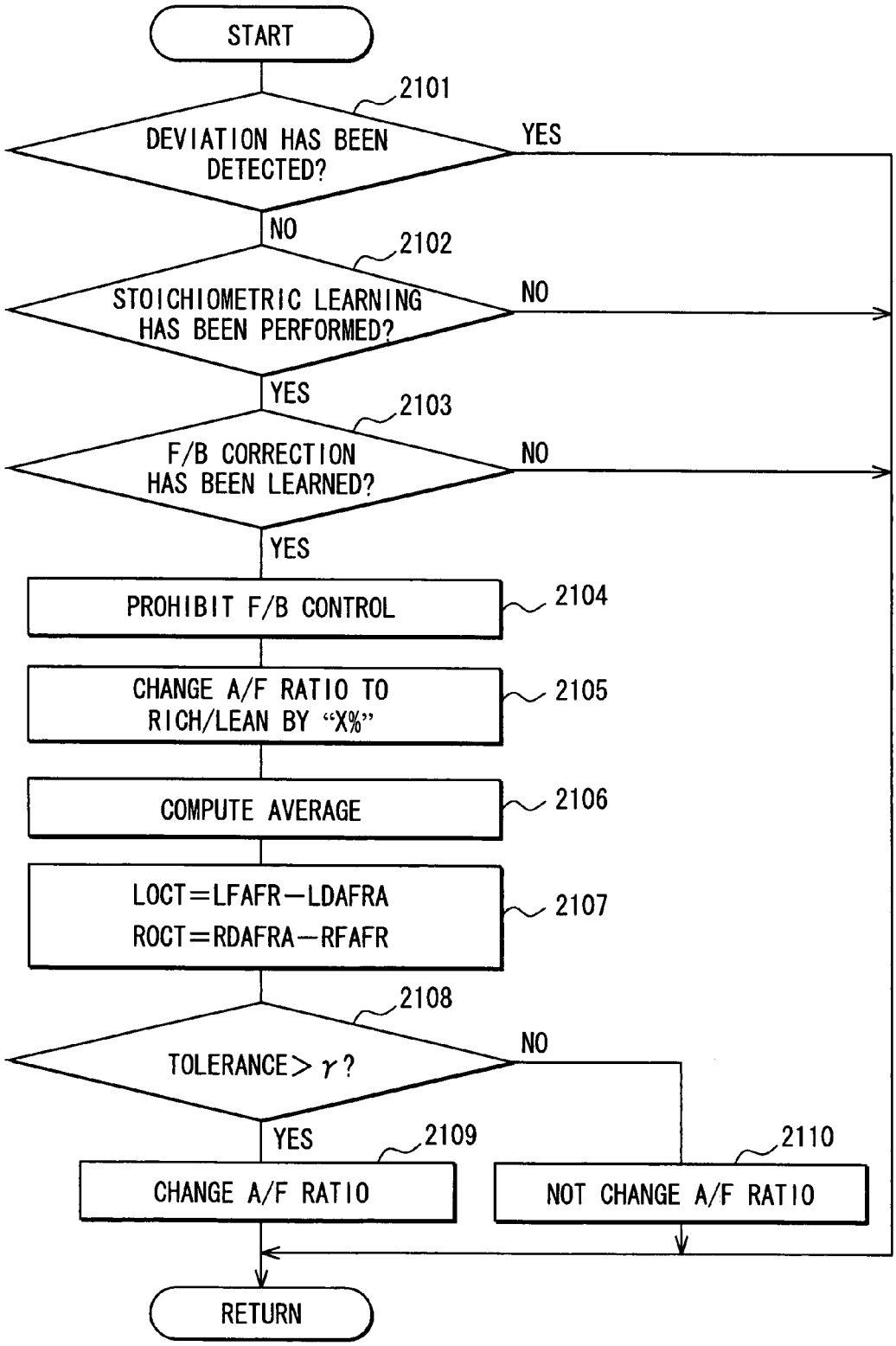
FIG. 6 is a flowchart showing a process of the air-fuel-ratio deviation detection program.

According to the air-fuel-ratio deviation detection program for each cylinder shown in FIG. 6, a detection processing of the air-fuel-ratio deviation for each cylinder is performed.

In step 2101, it is determined whether the air-fuel ratio deviation has been detected. When the answer is Yes in step 2101, this program is ended without performing subsequent processes.

When the answer is No in step 2101, the procedure proceeds to step 2101. At step 2102, it is determined whether stoichiometric learning of the air-fuel ratio sensor 20 has been performed. This stoichiometric learning is learning for adjusting the zero point so that the output current of the air-fuel ratio sensor 20 may be set to "0" at the time of the stoichiometric air-fuel ratio. When the air-fuel ratio sensor 20 is in the condition of non-activity (temperature is lower than the active temperature region), the output current of the air-fuel ratio sensor 20 becomes a value equivalent to the stoichiometric air-fuel ratio. Based on this characteristic, when the air-fuel ratio sensor 20 is in the condition of non-activity, the output current of the air-fuel ratio sensor 20 is taken into the ECU 24, and the deviation from the zero point is learned according to the output current. When the answer is No in step 2102, this program is ended without performing subsequent processes.

In step 2103, it is determined whether a F/B correction quantity of air-fuel ratio feed back control has been learned in the operating range where the output-characteristics tolerance is learned. The learning of this F/B correction quantity is performed under a condition in which the target air-fuel ratio is established as the stoichiometric air-fuel ratio. The operating range where the output-characteristics tolerance is learned is the steady operation region where it is after the completion of warming-up, for example, and engine speed is kept in a specified range. When the answer is No in step 2103, this program is ended without performing subsequent processes.

In order to previously learn product tolerances other than the tolerance in the output characteristics of the air-fuel ratio sensor 20, the stoichiometric learning and the learning of F/B correction quantity are required before learning the output-characteristics correction value.

When the answer is Yes in steps 2102 and 2103, the precondition for learning the output-characteristics tolerance is satisfied, and the output-characteristics tolerance will be learned as follows. In step 2104, the air-fuel-ratio F/B control is prohibited, and the air-fuel ratio is controlled by an open loop control. However, the learnt value of F/B correction quantity is reflected also in this open loop control.

Then, the procedure proceeds to step 2105 in which the air-fuel ratio (the target air-fuel ratio) of the air-fuel mixture supplied to each cylinder of the engine 11 is alternately varied to the rich direction or the lean direction predetermined times by a specified ratio (X %) in a given period, as shown in FIG. 5. In step 2106, the average value of the detected air-fuel ratio λ in the rich side and the lean side is respectively computed. By accumulating the sampling data of the detected air-fuel ratio to the memory of ECU 24 and performing the arithmetical average, the average value of the detected air-fuel ratio may be computed. Alternatively, the average value may be approximately computed by smoothing the detected air-fuel ratio in the rich side and the lean side.

In this case, when the feed air-fuel ratio changes twice or more, the average value is computed whenever the feed air-fuel ratio changes. And after change of the feed air-fuel ratio is completed, the arithmetical average of the average value for every change may be performed. Alternatively, the sampling data of the detected air-fuel ratio are accumulated in the memory of the ECU 24, and the arithmetical average value of the sampling data accumulated in the memory is computed after termination of the oscillation movement of the value λ.

Then, the procedure proceed to step 2107 in which the difference of the feed air-fuel ratio (target air-fuel ratio) being changed to rich/lean and the average value of air-fuel ratio detection is computed as a tolerance (deviation) of the output characteristics of the air-fuel ratio sensor 20.

Lean side output-characteristics tolerance (*LOCT*) =Lean side feed air-fuel-ratio (*LFAFR*)−Lean side detected air-fuel-ratio-detection average value (*LDAFRA*)

Rich side output-characteristics tolerance (*ROCT*) =Rich side detected air-fuel-ratio-detection average value (*RDAFRA*)−Rich side feed air-fuel-ratio (*RFAFR*)

In a case where the output-characteristic tolerance is computed according to the above equations, the output characteristic tolerance becomes large according the variation in output current of the air-fuel ratio sensor 20 becomes small relative to the variation in actual air-fuel ratio.

Then, the procedure proceeds to step 2108 in which one of a rich-side output-characteristic tolerance and a lean-side output-characteristic tolerance exceeds a predetermined value γ, whereby, It is determined whether the output characteristics of the air-fuel ratio sensor 20 deviates relative to the actual air-fuel ratio in a direction where the variation in output current becomes small. Alternatively, it may be determined whether the output-characteristics tolerance in both sides exceeds the predetermined value γ.

When the answer is Yes in step 2108, the procedure proceeds to step 2109. In step 2109, as shown in FIG. 7, the feed air-fuel ratio (target air-fuel ratio) of the engine 11 is alternately changed to rich/lean by the predetermined ratio (X %) in the predetermined period, and the air-fuel-ratio deviation is detected.

When the answer is No in step 2108, the procedure proceeds to step 2110 in which the ordinary air-fuel ratio control is performed and the air-fuel ratio deviation is detected from a small variation in output waveform of the air-fuel ratio sensor 20.

According to the present embodiment described above, the air-fuel ratio can be detected in the region where the output current of the air-fuel ratio sensor 20 is large, and it becomes easy to detect the air-fuel-ratio deviation for each cylinder. And it can maintain at neutrality, without biasing the condition of the catalyst 21 toward either rich/lean, and lowering of the exhaust-air-purification capacity of the catalyst 21 can be suppressed.

On the other hand, when it is determined that the output characteristics of the air-fuel ratio sensor 20 have not deviated since the air-fuel-ratio deviation is detected without changing the feed air-fuel ratio to rich/lean, the deviation is accurately detected without increasing the exhaust emission.

Besides, the output-characteristics tolerance of the air-fuel ratio sensor 20 may be computed from the ratio between the feed air-fuel ratio (target air-fuel ratio) and the average value of the detected air-fuel ratios.

What is claimed is:

1. An air-fuel ratio control system for an internal combustion engine, including an air-fuel ratio sensor which detects an air-fuel ratio of exhaust gas in an exhaust passage of the internal combustion engine, and controlling the air-fuel ratio (feed air-fuel ratio) which is supplied to the internal combustion engine based on an output of the air-fuel ratio sensor, the air-fuel ratio control system comprising:

an output-characteristics detection means for detecting output-characteristics data showing output characteristics of the air-fuel ratio sensor; and a sensor output correction means for correcting the output of the air-fuel ratio sensor or a detected air-fuel ratio based on the output-characteristics data detected by the output-characteristics detection means, wherein the output-characteristics detection means changes the feed air-fuel ratio to rich/lean, and detects the output-characteristics data by comparing a variation width of rich/lean with a quantity of an output change in the air-fuel ratio sensor.

2. An air-fuel ratio control system according to claim 1, wherein the output-characteristics detection means prohibits the feed back control of air-fuel ratio based on the output of the air-fuel ratio sensor, when changing the feed air-fuel ratio to rich/lean.

3. An air-fuel ratio control system according to claim 1, wherein the output-characteristics detection means changes the feed air-fuel ratio to rich/lean and detects the output-characteristics data after performing a stoichiometric learning of the air-fuel ratio sensor.

4. An air-fuel ratio control system according to claim 1, wherein detecting the output-characteristics data by the output-characteristics detection means includes determining a ratio between a variation width of the air-fuel ratio to the rich side and a variation amount of a rich-side detected value, and determining a ratio between a variation width of the air-fuel ratio to the lean side and a variation amount of a lean-side detected value.

5. An air-fuel ratio control system for an internal combustion engine, comprising:

an air-fuel ratio sensor provided in an exhaust confluent portion into which exhaust gas of a plurality of cylinders flows, the air-fuel ratio sensor detecting an air-fuel ratio of the exhaust gas;

a deviation detection means for detecting an air-fuel-ratio deviation for each cylinder based on an output of the air-fuel ratio sensor;

an air-fuel-ratio-control means for controlling a fuel injection quantity for each cylinder in such a manner as to decrease the air-fuel-ratio deviation for each cylinder; and an output-characteristics detection means for detecting an output characteristics of the air-fuel ratio sensor, wherein the air-fuel-ratio deviation detection means changes the air-fuel ratio (feed air-fuel ratio) supplied to the internal combustion engine to rich/lean, and detects the air-fuel-ratio deviation for each cylinder, when it is determined that the output characteristics of the air-fuel ratio sensor is deviated relative to an actual air-fuel ratio by a predetermined value or more in a direction in which a change in output current of the air-fuel ratio sensor is decreased, and the air-fuel-ratio deviation detection means detects the air-fuel-ratio deviation for each cylinder without changing the feed air-fuel ratio to rich/lean, when it is determined that the deviation of the output characteristics of the air-fuel ratio sensor is less than the predetermined value.

6. An air-fuel ratio control system according to claim 5, wherein the output-characteristics detection means changes the feed air-fuel ratio to rich/lean, and detects the output characteristics of the air-fuel ratio sensor based on a relationship between the variation width of rich/lean, and a quantity of output changes of the air-fuel ratio sensor.

7. An air-fuel ratio control system according to claim 6, wherein the output-characteristics detection means includes a prohibiting means which prohibits the feed back control of air-fuel ratio based on the output of the air-fuel ratio sensor in changing the feed air-fuel ratio to rich/lean.

8. A method of controlling an air-fuel ratio for an internal combustion engine, the method comprising:

detecting, with an air-fuel ratio sensor, an air-fuel ratio of exhaust gas in an exhaust passage of the internal combustion engine;

controlling a feed air-fuel ratio which is supplied to the internal combustion engine based on an output of the air-fuel ratio sensor;

detecting output-characteristics data showing output characteristics of the air-fuel ratio sensor; and correcting the output of the air-fuel ratio sensor or a detected air-fuel ratio based on the detected output-characteristics data, wherein the feed air-fuel ratio is changed to rich/lean, and the output-characteristics data is detected by comparing a variation width of rich/lean with a quantity of an output change in the air-fuel ratio sensor.

9. The method according to claim 8, further comprising prohibiting the feed back control of air-fuel ratio based on the output of the air-fuel ratio sensor, when changing the feed air-fuel ratio to rich/lean.

10. The method according to claim 8, further comprising changing the air-fuel ratio (feed air-fuel ratio) to rich/lean and detecting the output-characteristics data after performing a stoichiometric learning of the air-fuel ratio sensor.

11. The method according to claim 8, wherein detecting the output-characteristics data includes determining a ratio between a variation width of the air-fuel ratio to the rich side and a variation amount of a rich-side detected value, and determining a ratio between a variation width of the air-fuel ratio to the lean side and a variation amount of a lean-side detected value.

12. A method of controlling an air-fuel ratio for an internal combustion engine, the method comprising:

providing an air-fuel ratio sensor in an exhaust confluent portion into which exhaust gas of a plurality of cylinders flows, the air-fuel ratio sensor detecting an air-fuel ratio of the exhaust gas;

detecting an air-fuel-ratio deviation for each cylinder based on an output of the air-fuel ratio sensor;

controlling a fuel injection quantity for each cylinder in such a manner as to decrease the air-fuel-ratio deviation for each cylinder; and detecting an output characteristics of the air-fuel ratio sensor, wherein a feed air-fuel ratio supplied to the internal combustion engine is changed to rich/lean, and the air-fuel-ratio deviation is detected for each cylinder, when it is determined that the output characteristics of the air-fuel ratio sensor is deviated relative to an actual air-fuel ratio by a predetermined value or more in a direction in which a change in output current of the air-fuel ratio sensor is decreased, and the air-fuel-ratio deviation is detected for each cylinder without changing the feed air-fuel ratio to rich/lean, when it is determined that the deviation of the output characteristics of the air-fuel ratio sensor is less than the predetermined value.

13. The method according to claim 12, wherein the feed air-fuel ratio is changed to rich/lean, and the output characteristics of the air-fuel ratio sensor is detected based on a relationship between the variation width of rich/lean, and a quantity of output changes of the air-fuel ratio sensor.

14. The method according to claim 13, further comprising prohibiting the feed back control of air-fuel ratio based on the output of the air-fuel ratio sensor in changing the feed air-fuel ratio to rich/lean.

* * * * *